US005351743A

United States Patent [19]

Jackson

[11] Patent Number: 5,351,743

[45] Date of Patent: Oct. 4, 1994

[54] IMPROVED ROLLER SHUTTER ASSEMBLY

[75] Inventor: John Jackson, St. Helens, Great Britain

[73] Assignee: Rotalac Plastics Limited, Altrincham, England

[21] Appl. No.: 943,572

[22] Filed: Sep. 11, 1992

[51] Int. Cl.[5] ..... E06B 9/56

[52] U.S. Cl. ..... 160/310; 160/315; 160/323.1

[58] Field of Search ..... 160/310, 133, 191, 192, 160/265, 23.1, 313, 315, 323.1, 317, 294, 299, 301, 305, 370.2 A

[56] References Cited

U.S. PATENT DOCUMENTS

| | | | |
|---|---|---|---|
| 1,090,931 | 3/1914 | McLean | 160/313 |
| 1,202,964 | 10/1916 | Bumbarger | 160/317 |
| 1,500,585 | 7/1924 | Hayslett | 160/301 |
| 1,567,095 | 12/1925 | Anderson | 160/301 |
| 3,279,529 | 10/1966 | Smith et al. | 160/323.1 |
| 3,853,170 | 12/1974 | Barettella | 160/323.1 |
| 4,143,367 | 3/1979 | Schestag | 160/133 X |
| 4,342,354 | 8/1982 | Leivenzon et al. | 160/310 X |
| 4,482,137 | 11/1984 | Gavagan et al. | 160/315 X |
| 4,501,963 | 2/1985 | Perisic | 160/133 X |
| 4,633,927 | 1/1987 | Labelle | 160/133 |
| 4,712,104 | 12/1987 | Kobayashi | 160/310 X |
| 4,751,953 | 6/1988 | Appel et al. | 160/313 |
| 4,781,234 | 11/1988 | Okumura et al. | 160/23.1 |
| 4,887,660 | 12/1989 | Kraus | 160/310 X |
| 5,228,492 | 7/1993 | Jou | 160/133 X |

FOREIGN PATENT DOCUMENTS

| | | |
|---|---|---|
| 0046949 | 3/1982 | European Pat. Off. . |
| 0143712 | 6/1985 | European Pat. Off. . |
| 0187685 | 7/1986 | European Pat. Off. . |
| 0219454 | 4/1987 | European Pat. Off. . |
| 3002123 | 7/1981 | Fed. Rep. of Germany . |
| 2344705 | 10/1977 | France . |
| 2070115 | 9/1981 | United Kingdom . |
| 2126637 | 3/1984 | United Kingdom . |

*Primary Examiner*—David M. Purol

*Attorney, Agent, or Firm*—Dennison, Meserole, Pollack & Scheiner

[57] ABSTRACT

The invention provides an improved roller shutter assembly 10 including a cylindrical core 12 having end blocks 14 rigidly located at each end. At least one end block is provided with a mounting block 16 rotated mounted in a hole 20 in the end block 14. Provided between the mounting block 16 and the end block 14 is an annular space 32 which encloses a coiled spring 30. One end of the spring 30 is attached to the end block 14 and the other end to the mounting block 16. Thus as the blocks are rotated with respect to each other the spring is tensioned to provde a counteracting spring force to aid rewinding. Enclosure of the spring at the end blocks provides for easy maintenance and simplified construction. Each end block 14 may be provided with springs if desired. In a further embodiment the end block 14 is provided with an external peripheral cam shaped surface so as to facilitate even winding of a slatted blind.

8 Claims, 2 Drawing Sheets

IMPROVED ROLLER SHUTTER ASSEMBLY

BACKGROUND OF THE INVENTION

This invention relates to an improved roller shutter assembly especially for a roller shutter intended for use as a garage door or for a similar structure.

Spring tensioned roller shutters or blinds are commonly known for many uses for example as cabinet shutters, door or window shutters etc. In such constructions it is usual for the assembly to comprise a generally cylindrical roller onto which the shutter or blind is wound, the roller being journalled at each end by carrying means which are fixed relative thereto. The roller is connected to the carrying means by way of a co-axial central core or similar arrangement and by a helical spring such that rotation of the roller in one direction will cause tensioning of the spring. When the tension is released rotation of the roller in the opposite direction is caused.

It will thus be appreciated that in this way a shutter attached to the roller may be unfurled causing tensioning of the attached spring which is then held in place by a ratchet or similar mechanism. When the ratchet is released the tension in the spring causes the roller to rotate thereby rewinding the shutter thereon and raising it from its closed position.

Such an assembly has several problems. In the first place, is not easy to maintain the assembly in working condition especially if there is a breakage of the helical spring which will require complete disassembly in order to rectify the breakage. Furthermore the helical spring must be pre-tensioned before use which can be especially difficult where the roller shutter is intended for use as a garage door and is consequently of a substantial weight. Furthermore the construction described is not easy to provide with a motor as the drive must be applied to the cylindrical roller and not to the carrying means are the more easily accessible.

Further disadvantages of the known configuration are especially apparent when the known construction used for a garage door comprising a plurality of metal or similar slats. The substantial size of a garage door means that the blind in question will invariably be fairly hearty and the slats of fairly broad width. This causes a problem insuring the smooth winding of the slats which because of their thickness will form an irregularly shaped roll. Furthermore there will always be a transition point between one layer of slats around the roller and the next causing a bump or protrusion the rolled shutter surface.

SUMMARY OF THE INVENTION

It is an object of the present invention to provide an improved roller shutter assembly in which the construction is simplified as compared to prior assemblies and which will permit easy motorisation.

With this object in view a first aspect of the invention provides an improved roller shutter assembly comprising an elongate core having at each end an end block, at least one of said end blocks having a carrying block rotatably mounted therein, said carrying block being attached to said end block by spring means disposed so as to be tensioned by rotation of said end block with respect to said carrying block.

Preferably said spring means is in the form of a coiled spring one end of which is attached to said end block and the other end being attached to said carrying block. Additionally the spring is advantageously disposed around said carrying block in a space provided between said carrying block and said surrounding end block.

Advantageously said carrying block is provided with a spring loaded retractable mounting pin received in a housing provided in said carrying block such that said assembly may be mounted in a supporting bracket.

In order to provide for more even rolling of a slatted shutter the improved roller shutter assembly preferably includes an elongate tubular core having at least at each end thereof an end block of a larger diameter than said tubular core, each said end block being shaped to provide a cam surface having a substantially radially disposed step.

With such a radially disposed step it will be appreciated that the configuration is advantageously used with a roller shutter comprising a plurality of rigid slats. In such an arrangement the first slat of the shutter lies radially adjacent to the step such that there is a smooth winding of successive layers around the end block of the roller blind assembly Where the length of the slatted shutter is over one meter it is advantageous to provide said elongate core with an additional centre block shaped correspondingly to each said end block in order to provide additional support.

In an advantageous modification of this aspect the invention a cam shaped end block is provided as separate disc placed adjacent to said end blocks already present in a roller shutter assembly. In this way existing assemblies may be modified to permit a smooth take-up of a plurality of roller shutter slats.

Alternatively the cam shaped exterior surface may be formed integrally with an end block according to the first aspect of the invention such that said end block is directly attached via a coil spring to said carrying block for rotation.

In a third aspect, the invention provides an improved roller shutter assembly comprising a shutter wound around a roller including an elongate core and at least two end blocks, said cylindrical core being arranged to be rotated by way of motor means and said assembly being further provided with sensor means operative to sense resistance to unwinding of a shutter and on sensing same operative to stop rotation of said roller via switching of said motor means.

Advantageously the switching of said motor means is such as to automatically reverse the direction of said motor drive such that on its next operation said shutter will be wound onto said roller and hence raised from its closed position.

Advantageously a separate sensor is provided operative to detect said shutter in its raised or fully wound position and prevent further rotation of the roller by switching of said motor means.

In a preferred embodiment of this aspect of the invention the roller shutter is provided by a plurality of linked rigid slats and advantageously the roller is provided with end blocks having a cam profile according to the second aspect of the invention.

BRIEF DESCRIPTION OF THE DRAWINGS

The invention will now be described further by way of example with reference to the accompanying drawings in which.

DESCRIPTION OF THE PREFERRED EMBODIMENTS

Figure 1:
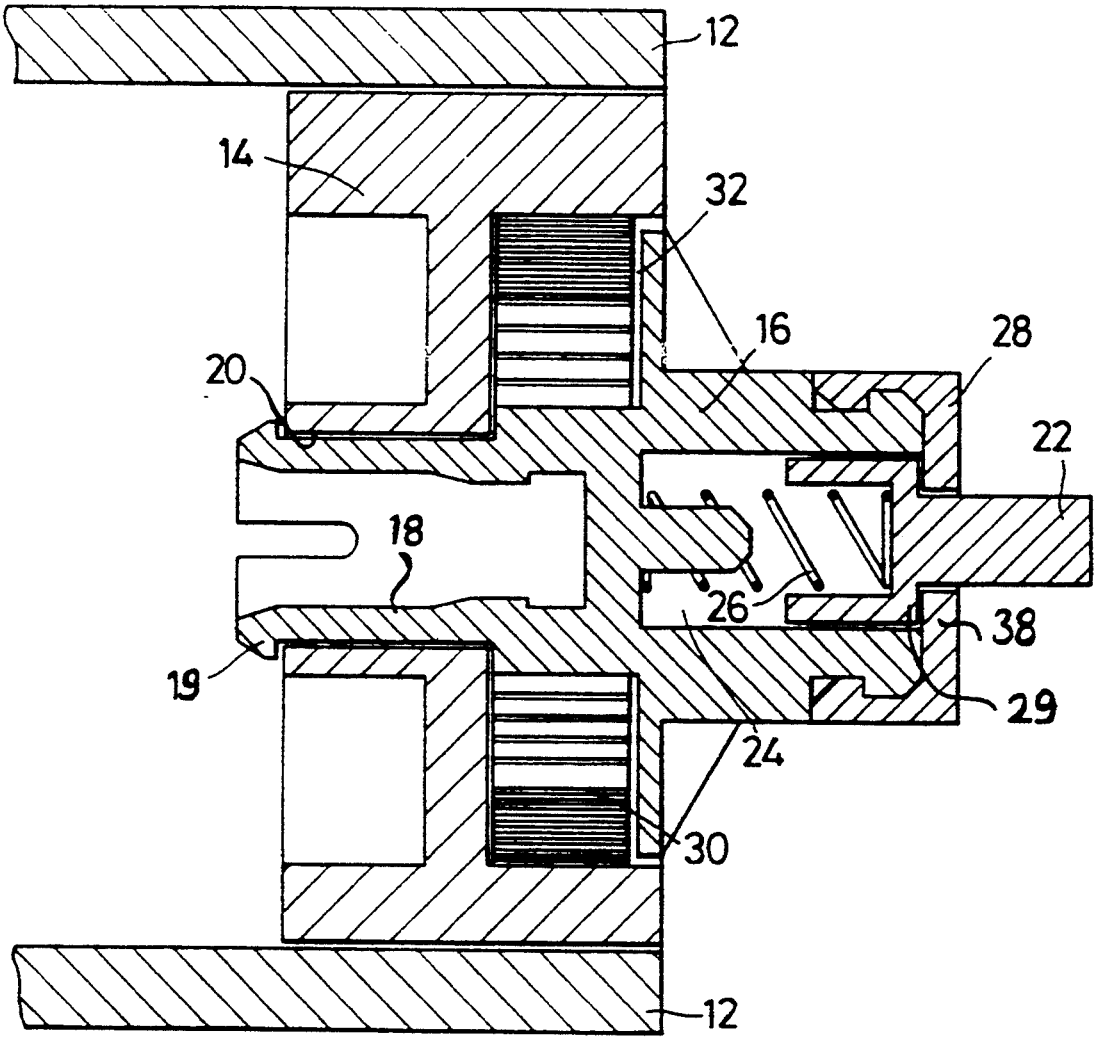
FIG. 1 is a sectional view of an end block of a roller shutter assembly according to a first aspect of the invention.

Referring firstly to FIG. 1 a preferred embodiment of an improved roller shutter assembly 10 according to a first aspect of the invention includes an elongate tubular roller core 12 to which is attached at each end an end block 14 of which only one is shown for simplicity. The end block is circular in shape and fits within the open end of the tubular core 12 and is secured there by way of, for example, a screw or other similar fastening means (not shown).

A carrying mounting block 16 is provided with a shaft portion 18 which is rotatably mounted in a hole 20 provided in the end block 14. The shaft 18 is retained in the hole 20 by projecting lugs 19 which engage with the end block. In this way the end block 14 is rotatable about the mounting block 16. In order to provide the releasable mounting of an assembled roller between two supporting brackets (not shown) mounting pins 22 are provided in a housing 24 of each end block 16. To permit depression of the mounting pin 22 a spring 26 is located within the housing 24 and operative to urge the mounting pin 22 outwardly of the housing 24. Outward movement of the mounting pin 22 is constrained by provision of a cap 28 secured over the housing 24 and having an inwardly directed lip 38 which engages with shoulders 29 on the pin 22.

As the mounting block 16 should be carried by the support brackets so as to be relatively non-rotatable with respect to the roller it is advantageous to provide one or other of the mounting pins 22 as a square or other regular polygonal cross-section. In this way rotation of the pin 22 within the support bracket is prevented. Both pins could be provided with the necessary square cross-section, however this is not necessary and only one such pin need be provided for correct operation of the roller shutter.

It will be appreciated that with the disclosed arrangement the roller shutter assembly may be journalled between two support brackets such that the roller 12 is rotatable with respect to the two relatively fixed end blocks 14. However when the shutter (not shown) is lowered it will require rotation. of the roller in order to rewind it. In order to accomplish this a clock type coil spring 30 is arranged. in a space 32 formed between the end block 14 and the carrying or mounting block 16. This space 32 is approximately annular and the coil spring is arranged within it such that the spring's innermost end is connected to the mounting block 16 and the spring's outermost end is connected to the end block 14. Thus as the end block is rotated with respect to the mounting block the spring 30 is tensioned or relaxed according to the relative direction of rotation. The spring 30 is preferably disposed such that unfurling of a shutter attached to the roller 12 causes tensioning of the spring 30 sufficient to provide a rewinding force on the roller 12 when the shutter is permitted to rise.

In order that the shutter is retained in its unwound configuration, against the action of the spring 30, a ratchet or similar mechanism (not shown) is provided such that the roller may be selectively held any desired position and easily released to be rewound under action of the tensioned spring 30.

Figure 2:
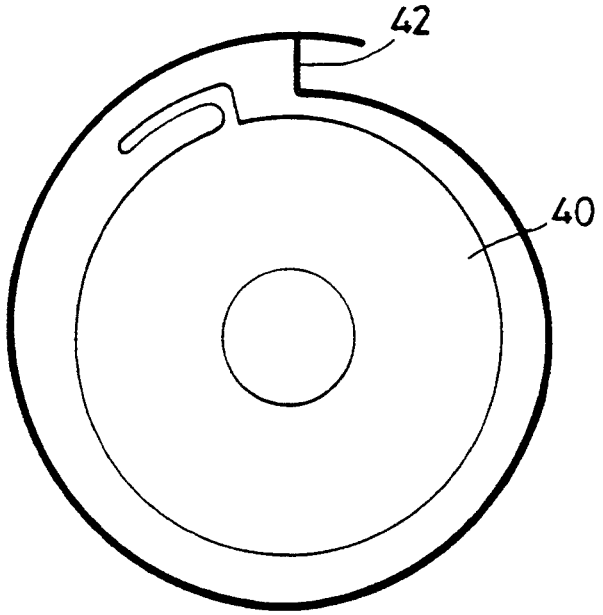
FIG. 2 is a end view of an end block of an improved roller shutter assembly according to a second aspect of the invention.

Turning now to FIG. 2 a second aspect of the improved roller shutter assembly according to the invention is illustrated in which the end block's peripheral surface is shaped as a cam profile 40 having a step 42, substantially radial of the axis of rotation, at one point on its periphery. This arrangement is intended for use with a roller shutter comprising a plurality of linked slats (not shown).

In a roller shutter in which the blind is formed of a fabric or similar thin flexible material it will be appreciated that no discernable step is formed at the starting point for the winding of the material around the roller. Thus there is a consistantly smooth take-up during winding and unwinding.

In the case of a slatted shutter construction however the starting point provides a significant radial step about the axis of rotation and consequent problems in providing a smooth and consistant take-up of slats onto the roller. In the proposed arrangement the step 42 provided on the periphery of the cam profile 40 is intended to seat the first slat of the shutter. It will be appreciated that when the shutter is rolled around the cam profile the second layer of slats will be smoothly and easily wound around the first without a sudden increase in rotational radius as would normally be the case.

In such an arrangement the slats are supported by the cam profile and not on the cylindrical roller 12. Thus the roller is preferably replaced by a tubular core, advantageously of square cross section, which fits within the end block 14 such that the profile will protrude from of the core's surface.

The cam profile indicated may be incorporated as the peripheral surface of an end block 14 as described in FIG. 1 or alternatively may be a separate part for example a disc which could be attached to the end block 14 either around the existing periphery of the end block or adjacent to it such that the cam profile 40 protrudes relative to the end block's own peripheral surface. It will also be appreciated that in this configuration there is also no requirement for a cylindrical roller 12 to be provided around the end profile and a cylindrical or tubular shaft can be provided extending between two end blocks 14 which shaft does not contact the slots of the shutter construction.

Where the width of slats exceeds one meter it may be required to provide additional support at least at the centre of such slats (and in some cases at other points as well). In such an instance a third (or more) cam profile 40 will be provided spaced along the central shaft and with its step 42 in alignment with respective steps 42 on end block cam profiles 40. In this way the slats of the shutter can be supported. across its entire length when so required.

Figure 3:
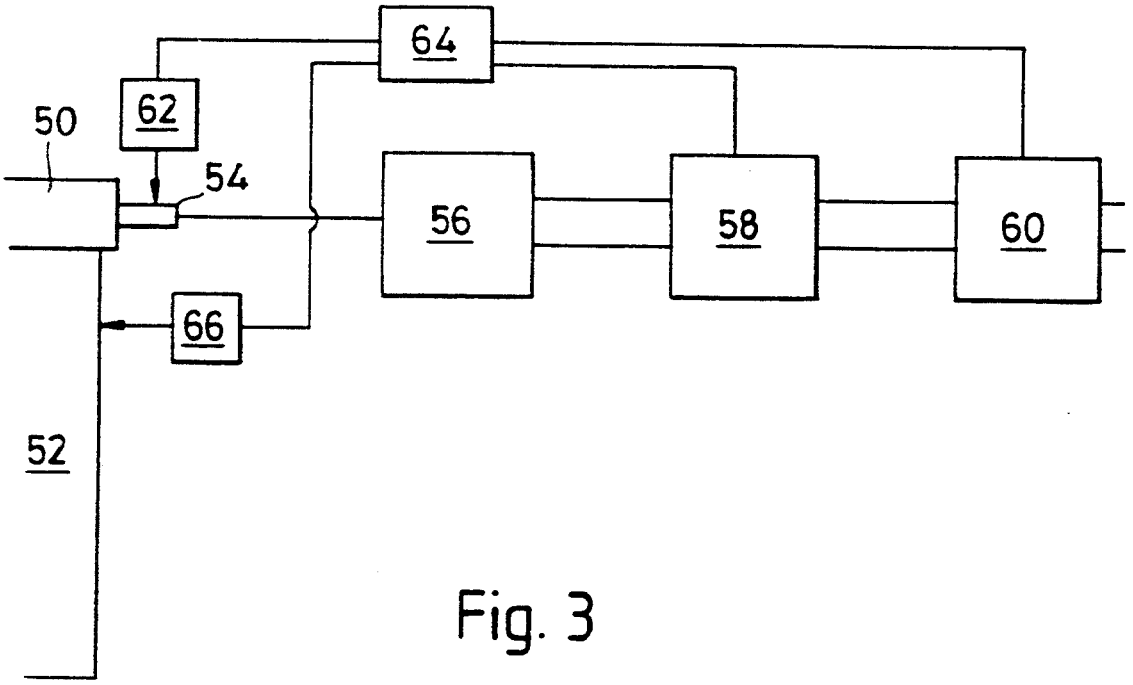
FIG. 3 is a block diagram illustrating a third aspect of the invention.

Turning now to FIG. 3 a complete garage door shutter assembly is illustrated as a block diagram to illustrate the operation of a further aspect of the invention comprising feed-back control apparatus operative to sense the position of a roller shutter and control drive means attached thereto. In the figure a roller shutter assembly comprises a roller 50 about which is wound a shutter 52. In common garage door configurations the shutter 52 will comprise a plurality of rigid slats in order to provide a door having a required structural integrity.

The roller 50 has a shaft 54 to which is attached motor drive means 56 operative to cause rotation of the shaft in response to operation of a switch 58.

A sensor 62 is mounted on or adjacent to the shaft 54 so as to sense resistance to rotation of the shaft as would be caused by the blind's lower edge reaching ground level. On sensing a resistance to rotation of the shaft the sensor 62 passes a control signal to a feed-back controller 64. In response to the receipt of this signal the feed-back controller 04 sends a control signal to the switch 58 turning same to off position and hence stopping rotation of the shaft 54. Furthermore the feed-back control also actuates second switching means 60 operative to reverse the polarity of the electrical supply to the switch 58 such that actuation thereof will now cause rotation of the shaft 54 in the opposite direction.

A second sensor 66 is mounted below the shaft adjacent to one edge of the shutter 52. This second sensor 66 is operative to detect the shutter 52 when it is in its raised position and actuates the feed-back controller 64 to firstly stop rotation of the shaft by and to reverse polarity such that a further actuation of the switch 58 will cause a lowering of the shutter 52.

It will be appreciated that the feed-back control circuit illustrated may be attached to any roller blind construction. However it is advantageously combined with at least the cam profile 40 according to the second aspect of the invention which provides benefits for rolling of a roller shutter having a slatted construction. The invention can be applied to office storage cabinets or other roller shutter arrangements and is not restricted to garage doors.

I claim:

1. An improved roller shutter assembly comprising an elongate core having opposed ends, the core having at each said end an end block onto which the shutter is to be wound, each said end block being of larger diameter than the elongate core and shaped to provide a substantially radially disposed step at which an end of the shutter is to be located, at least one of said end blocks having a carrying block rotatably mounted therein, said carrying blocks being attached to said at least one end block by spring means disposed so as to be tensioned by rotation of said end block with respect to said carrying block.

2. An improved roller shutter assembly as claimed in claim 1 in which the spring means is in the form of a coiled spring one end of which is attached to said end block and the other end being attached to said carrying block.

3. An improved roller shutter assembly as claimed in claim 1 in which said spring means is a spring disposed around said carrying block in a space provided between said carrying block and said end block, with one end attached to said end block and the other end attached to said carrying block.

4. An improved roller shutter assembly as claimed in claim 1 in which a spring loaded retractable mounting pin is received in a housing provided in said carrying block such that the assembly may be mounted in a supporting bracket.

5. An improved roller shutter assembly as claimed in claim 1 in which said elongate core is provided with a centre block shaped to provide a peripheral cam surface corresponding to each said end block and located substantially centrally of said core to provide additional support.

6. An improved roller shutter assembly as claimed in claim 1 in which said core is arranged to be rotated by way of motor means and said assembly being further provided with sensor means operative to sense resistance to unwinding of the said shutter and an sensing same operative to stop rotation of said core via switching of said motor means.

7. An improved roller shutter assembly as claimed in claim 6 in which said switching of said motor means is such as to automatically reverse the direction of said motor means such that on its next operation said shutter will be wound onto said core and hence raised from its closed position.

8. An improved roller shutter assembly as claimed in claim 7 in which a second sensor is provided operative to direct said shutter in its raised or fully wound position and prevent further rotation of said core by switching of said motor means.

* * * * *

UNITED STATES PATENT AND TRADEMARK OFFICE

CERTIFICATE OF CORRECTION

PATENT NO. : 5,351,743

DATED : October 4, 1994

INVENTOR(S) : John Jackson

It is certified that error appears in the above-indentified patent and that said Letters Patent is hereby corrected as shown below:

Column 6, line 26, "elongate" should appear before "core".

Column 6, line 29, "an" should be --on--.

Signed and Sealed this

Fifteenth Day of November, 1994

*Attest:*

Bruce Lehman

BRUCE LEHMAN

*Attesting Officer*

*Commissioner of Patents and Trademarks*